United States Patent [19]

Takenoya et al.

[11] Patent Number: 4,530,296

[45] Date of Patent: Jul. 23, 1985

[54] LOWER THREAD TENSION ADJUSTING DEVICE OF SEWING MACHINES

[75] Inventors: Hideaki Takenoya, Hachioji; Nobumitu Kuribayashi, Sagamihara; Eiichi Shomura, Hachioji, all of Japan

[73] Assignee: Janome Sewing Machine Industry Co., Ltd., Japan

[21] Appl. No.: 502,780

[22] Filed: Jun. 9, 1983

[30] Foreign Application Priority Data

Jun. 10, 1982 [JP] Japan ..... 57-98470

[51] Int. Cl.[3] ..... D05B 63/00

[52] U.S. Cl. ..... 112/229; 112/254

[58] Field of Search ..... 112/228, 229, 230, 231, 112/254

[56] References Cited

U.S. PATENT DOCUMENTS

| | | | |
|---|---|---|---|
| 2,690,726 | 10/1954 | Wener | 112/231 |
| 2,763,227 | 9/1956 | Howard | 112/231 |
| 4,331,090 | 5/1982 | Hanyu et al. | 112/229 |
| 4,377,980 | 3/1983 | Hanyu et al. | 112/254 |
| 4,429,649 | 2/1984 | Eguchi et al. | 112/229 |

FOREIGN PATENT DOCUMENTS

| | | | |
|---|---|---|---|
| 3003501 | 8/1980 | Fed. Rep. of Germany | 112/229 |
| 536218 | 11/1955 | Italy | 112/231 |
| 747528 | 4/1956 | United Kingdom | 112/231 |

*Primary Examiner*—Wm. Carter Reynolds
*Attorney, Agent, or Firm*—William A. Drucker

[57] ABSTRACT

A sewing machine has a loop taker rotated in horizontal plane and a bobbin carrier contained in the loop taker. The bobbin carrier has an abutment secured thereto and a leaf spring mounted on the abutment and movable to and away from the abutment to adjust a tension applied to a lower thread extending between the abutment and the leaf spring. A plurality of windings are provided on a stationary horizontal plane adjacent the underside of the loop taker. The windings are progressively energized by selective operation of an electric control part to create a revolving magnetic field. A magnet is rotated in accordance with the revolving magnetic field, and the rotation of the magnet is transmitted through a series of gears to a cam which actuates a member influencing the movement of the leaf spring, thereby adjusting the tension applied to the lower thread.

2 Claims, 6 Drawing Figures

LOWER THREAD TENSION ADJUSTING DEVICE OF SEWING MACHINES

BACKGROUND OF THE INVENTION

The invention relates to a lower thread tension adjusting device used in combination with a sewing machine.

When a fabric is sewn with a sewing machine, it is generally necessary to properly adjust the upper and lower thread tension in dependence upon a kind or thickness of the fabric as well as the stitching types. For this purpose, hitherto, a bobbin carrier or bobbin case is provided with an abutment and a leaf spring to give a tension to a lower thread carried by the bobbin carrier or bobbin case. More particularly, by manipulation of an adjusting screw the pressure of the leaf spring against the abutment is adjusted to thereby adjust the tension of the thread extending between the abutment and the leaf spring. The operation of such a conventional adjustment of lower thread tension is, however, very troublesome and time-consuming. Moreover, it has been impossible to adjust the tension during the stitching operation. Further, the adjustment has to be carried out by guesswork, which often requires readjustment.

SUMMARY OF THE INVENTION

It is therefore an object of the invention to eliminate the defects and disadvantages which have often been encountered in the prior art adjustment of the lower thread tension.

Another object of the invention is to provide an improved device for adjusting a lower thread tension with convenience, even while driving a sewing machine.

It is still another object of the invention to facilitate a rapid and accurate adjustment of the lower thread tension in accordance with respective requirements in stitching types.

Accordingly there is provided a device for adjusting a lower thread tension used in combination with a sewing machine having a loop taker rotated in a horizontal plane and a bobbin carrier contained in the loop taker and carrying therein a bobbin loaded with a lower thread, the bobbin carrier having an abutment secured thereto and a resilient plate mounted on the abutment, the resilient plate being movable to and away from the abutment to adjust a tension applied to the lower thread extending between the abutment and the resilient plate, the device comprising a plurality of windings provided on a stationary horizontal plane adjacent the underside of the loop taker; control means selectively operated to progressively energize the windings for producing a revolving magnetic field; a magnet turnably mounted on the bobbin carrier and arranged opposite to the windings so that the magnet is rotated in accordance with the revolving magnetic field; and actuating means operated in association with the magnet to move the resilient plate to and away from the abutment in dependence upon the revolving direction of the magnetic field, thereby adjusting the tension applied to the lower thread.

BRIEF DESCRIPTION OF DRAWINGS

Further objects and advantages of the invention can be fully understood from the following detailed description when read in conjunction with the accompanying drawings in which.

PREFERRED EMBODIMENT OF THE INVENTION

Figure 1:
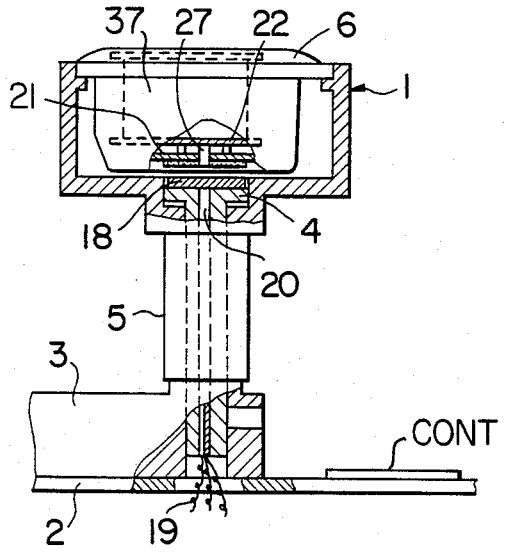
FIG. 1 is a vertical section showing the whole part of an embodiment of the invention.
Figure 3:
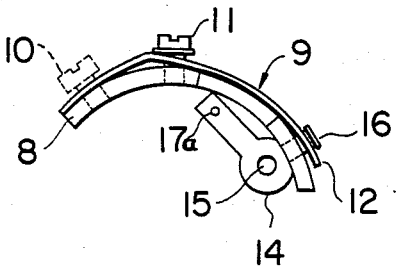
FIG. 3 is a plan view showing a specific part of the bobbin carrier shown in FIG. 2.
Figure 2:
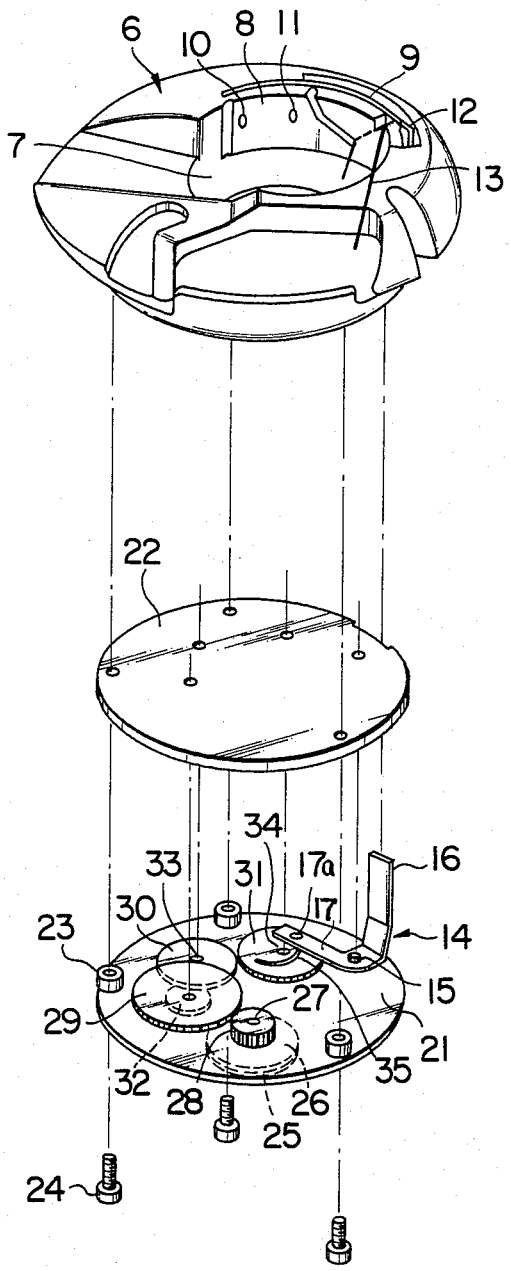
FIG. 2 is an exploded perspective view showing a structure of a bobbin carrier embodying a mechanical part of the invention.

Referring specifically to FIG. 1, a horizontal loop taker 1 is formed integrally with a vertical extending gear shaft 5 which is in engagement with a horizontally arranged drive gear shaft (not shown) and mounted on a vertical gear shaft 4, so that the loop taker 1 may be rotated on the shaft 4 which is provided with a central hollow path 20 and is fixed to a stationary seat 3 of a sewing machine housing 2. A bobbin carrier 6 is detachably mounted within the loop taker 1 and prevented from rotation during the rotation of the loop taker 1, in a conventional manner. The bobbin carrier 6 is provided with a central open chamber 7 for accomodating a bobbin 37 as shown in FIG. 2. As conventionally, the bobbin carrier 6 has an arcuate base plate or abutment 8 and a resilient plate 9 each forming a part of the chamber 7 and attached thereto by means of a fastening screw 10. A lower thread 13 is passed between the arcuate base plate 8 and resilient plate 9 while being pressed therebetween, and a degree of tension applied to the lower thread is initially adjusted to a predetermined value by manipulation of an adjusting screw 11. A free end 12 of the resilient plate 9 may be depressed toward the base plate 8 by a vertically extending arm 16 of an operating lever 14. Thus, a tension additional to the predetermined initial value is applicable to the lower thread by rotation of the lever 14, as described in detail hereinafter.

Figure 4:
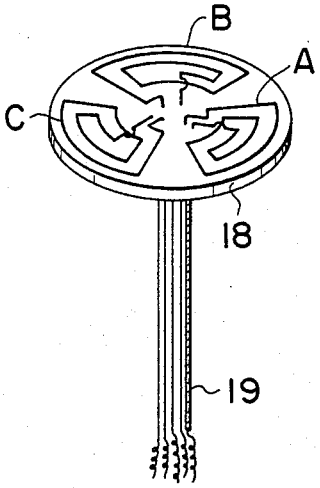
FIG. 4 is a perspective view showing an electric part of the invention.

On the upper end of the shaft 4 is fixed a disc 18 having a plurality of windings (A), (B) and (C) provided thereon in the three angular parts, as illustrated in FIG. 4. Each end of the winding is connected to a lead 19 extending through the hollow path 20 of the shaft 5 and then connected to an electric control part (CONT) provided on the housing 2. By manual or signal operation of the control part, the windings (A), (B) and (C) are selectively energized and electrically charged so that a magnetomotive force may be generated in a direction perpendicular to the disc 18.

Figure 5:
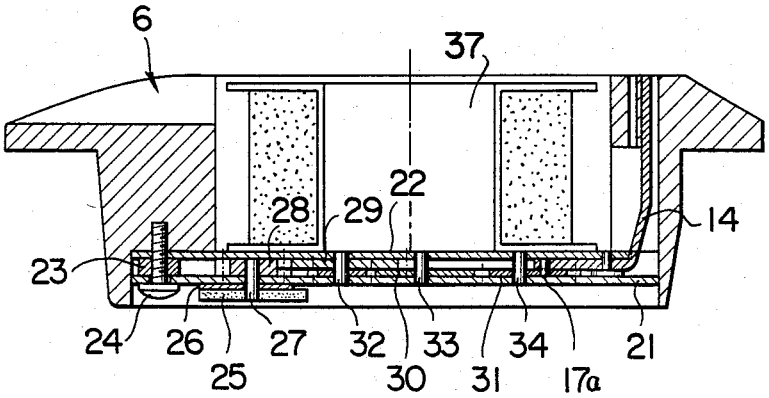
FIG. 5 is a sectional view showing a combined structure of the bobbin carrier shown in FIG. 2.

To the bobbin carrier 6 is attached by screws 24 a bottom plate 21 of a nonmagnetic substance and a cover plate 22, with spacers 23 provided therebetween, as shown in FIGS. 2 and 5. The bottom plate 21 is provided with a rotating axis 27 vertically extending therethrough. A circular magnet 25 and a disc 26 of a magnetic material are secured at the lower end of the axis 27 and arranged on the lower side of the plate 21, and at the upper end of the axis 27 and on the upper side of the plate 21 is secured a gear 28. When the bobbin carrier 6 is received in the loop taker 1 as shown in FIG. 1, the axis 27 is aligned with the shaft 4 with a clearance provided between the magnet 25 and the disc 18 for smooth rotation thereof. There will be a magnetic attraction between the magnet 25 and the windings (A), (B) and (C) which are selectively energized, so that the magnet 25 may be rotated. More particularly, the magnet 25 is divided into two polarities N,S in the respective semicircles on one side thereof, and is divided into two polarities S,N in the respective semicircles on the other side thereof. Accordingly, the magnet 25 and the windings may attract each other at different fields when the windings are selectively energized, and the magnet 25 may follow the change of windings selectively energized. The shaft 4 and the disc 26 are made of magnetic material for strengthen the magnetic path from windings to magnet 25 respectively.

Figure 6:
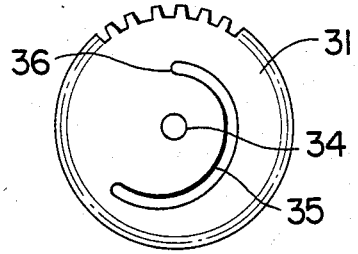
FIG. 6 is a plan view showing a structure of the element shown in FIG. 2.

Gears 29, 30 and 31 are mounted on axes 32, 33 and 34 respectively and rotatable therearound. These gears are in mesh with each other to transmit the rotation of the gear 28 with a reduced or even rate of speed. The gear 31 is, as shown in detail in FIG. 6, provided with a grooved cam 35 which cooperates with a guide pin 17*a* secured to the other arm 17 of the lever 14 which is pivoted on an axis 15 secured to the bottom plate 21. When the guide pin 17*a* engages one end 36 of the cam 35 during rotation of gear 31, the lever 14 is in a position as being rotated most in the counterclockwise direction. In this position the arm 16 adjusts the resilient plate 9 to give an initial predetermined minimum value of tension to the lower thread. Since the cam 35 is farther from the axis 34 as it goes farther from the end 36, the rotation of gear 31 in the counterclockwise direction will cause the lever 14 to rotate in the clockwise direction so that the arm 16 may progressively press the resilient plate 9 toward the base plate 8, thereby applying an additional degree of tension to the lower thread. Thus, the thread tension adjustment may be carried out in a region defined by six rotation of the magnet 25.

When the control part (CONT) is so operated that each winding is energized in one and the same direction, one by one succesively in the order such as (A)-(B)-(C)-(A)-(B)-(C), there will be generated a magnetic field on the disc 18 rotating in the counterclockwise direction, which will influence a specific magnetic flux of the magnet 25 mounted opposite to the disc 18. Then, the magnet 25 will rotate in accordance with the revolving magnetic field.

For the initial set of the lower thread tension, the windings (A), (B) and (C) are successively energized in the order named to rotate the magnet 25 in one way until the guide pin 17*a* engages the end 36 of the grooved cam 35. At this time, the lower thread tension is adjusted to the minimum, that is the predetermined initial value. When it is desired to apply an additional degree of tension to the lower thread, the control part (CONT) is again operated to rotate the magnet 25. Rotation of magnet 25 is transmitted to gear 31 by way of gears 28, 29 and 30. As the result, the grooved cam 35 cooperates with the guide pin 17*a* and actuates the vertical arm 16 to progressively increases the lower thread tension, even while driving the sewing machine. Thus, according to the invention, the sewing machine operator can easily and visibly adjust the lower thread tension in accordance with the actual stitching conditions. Once the lower thread tension is adjusted to an optimum value, the control part (CONT) is so operated as to stop the rotation of magnet 25 and thereby maintain the optimum value of tension.

Instead of energizing the windings (A), (B) and (C) one by one, each winding may be energized in different directions to generate revolving magnetic field. For example, provided that the winding (A) is energized in one direction (represented by a symbol $\underline{A}$) and at the same time the windings (B) and (C) are energized in the opposite direction (represented by $\overline{B}$ and $\overline{C}$), then the condition represented by $\overline{A}$-$\underline{B}$-$\overline{C}$ is created in the next step, and then the condition $\overline{A}$-$\overline{B}$-$\underline{C}$.

As many different embodiments of the invention may be made without departing from the spirit and scope thereof, it is to be understood that the invention is not limited to the specific embodiments thereof except as defined in the appended claims.

What is claimed is:

1. Improvement in lower thread tension adjusting device of a sewing machine having a loop taker rotated in a horizontal plane and a bobbin carrier contained in said loop taker and carrying a bobbin loaded with a lower thread, said bobbin carrier having an abutment secured thereto and a resilient plate mounted on said abutment, said resilient plate being movable to and away from said abutment to adjust a tension applied to said lower thread extending between said abutment and said resilient plate, the improvement comprising;

(i) a plurality of windings provided on a stationary horizontal plane adjacent the underside of said loop taker;

(ii) control means selectively operated to progressively energize said windings for producing a revolving magnetic field;

(iii) a magnet turnably mounted on said bobbin carrier and arranged opposite to said windings so that said magnet is rotated in accordance with said revolving magnetic field; and (iv) actuating means operated in association with said magnet for moving said resilient plate to and away from said abutment in dependence upon the revolving direction of said magnetic field, thereby adjusting the tension applied to said lower thread.

2. The improvement according to claim 1 wherein said actuating means comprises a cam, a lever adapted to act on said resilient plate and a series of gears for transmitting rotation of said magnet to said cam, said lever being cooperated with said cam to move said resilient plate to and away from said abutment.

* * * * *